United States Patent [19]

Heubel

[11] Patent Number: 5,062,552

[45] Date of Patent: Nov. 5, 1991

[54] SPOUT FOR DIFFERENT SIZE CANS

[76] Inventor: Walter Heubel, Bergstrasse 7, 8901 Aystetten, Fed. Rep. of Germany

[21] Appl. No.: 463,509

[22] Filed: Jan. 11, 1990

[30] Foreign Application Priority Data

Jan. 11, 1989 [DE] Fed. Rep. of Germany ... 8900273[U]

[51] Int. Cl.[5] ..... B65D 25/48

[52] U.S. Cl. ..... 222/570; 222/542

[58] Field of Search ..... 222/479, 481, 542, 566, 222/570; 220/855 P, 90.2, 90.4, 90.6, 287

[56] References Cited

U.S. PATENT DOCUMENTS

| | | | |
|---|---|---|---|
| 2,545,350 | 3/1951 | Fuld | 222/460 |
| 4,387,826 | 6/1983 | Heubl | 222/570 |
| 4,579,257 | 4/1986 | Brandlein | 222/542 |
| 4,583,668 | 4/1986 | Maynard, Jr. | 220/287 |
| 4,790,444 | 12/1988 | Terzi | 222/192 |

*Primary Examiner*—Michael S. Huppert
*Assistant Examiner*—Phillipe Derakshani
*Attorney, Agent, or Firm*—McGlew & Tuttle

[57] ABSTRACT

The present invention pertains to a development of can caps for cans 1, 2 whose lids have a circular edge bead 3 as well as a wall section 4 that can be torn up to form a pouring opening 5. In order to close cans 1, 2 of different diameters with the same cap, the present invention provides for a longer, curved front edge web 9 and a plurality of individual webs 10, 11 at different locations from the curved front edge web 9, on the other hand, on the basic body 7 of the cap. The radial spacing 12 between the individual webs 10, 11 corresponds approximately to the thickness of the lid edge bead 3 of the can 1, 2. All the webs 9, 10, 11 are shaped such that they are able to reach behind the lid edge bead 3 of cans 1, 2 of different size in the manner of a snap cap. The cap lid is sealed against the can cap via a sealing ring 8 guided and held on the cap, which is pressed against the outer surface of the lid surrounding the pouring opening 5 of the can lid.

9 Claims, 1 Drawing Sheet

SPOUT FOR DIFFERENT SIZE CANS

FIELD AND BACKGROUND OF THE INVENTION

The present invention pertains to a cap for cans provided with a lid edge bead and a lid wall part that can be torn open to form a pouring opening.

The capped body is positioned over the lid wall part above the pouring opening and is provided with a sealing ring pressed against the lid wall part for sealing around the pouring opening.

Such caps are known from European Patent 0,045,439. The prior art cap consists of a basic body made of plastic. The basic body spans over the lid and has—on the side facing said lid—a sealing ring for being pressed against the lid area surrounding the pouring opening, as well as front edge webs for gripping resiliently behind the lid edge bead. One of the front edge webs of which the one front edge web has a curvature adjusted to the diameter of the edge bead and the opposite front edge web consists of at least two nose-shaped individual webs.

The prior art can caps are suitable only for closing suitable cans. As soon as the diameter of the can deviates from the basic dimensions, the prior art cap is not effective, either because the tension is too weak and tightness is therefore not ensured, or because tensioning cannot be brought about at all due to oversize.

SUMMARY AND OBJECTS OF THE INVENTION

The basic task of the present invention is therefore to develop a cap of the class specified above, such that it can be used equally effectively for cans of different diameters.

Based on European Patent No. 0,045,439, the essence of the present invention is the fact that a plurality of individual webs are arranged at different radially spaced locations from the curved front edge web, wherein the spacing between the radially spaced individual webs corresponds approximately to the thickness of the lid edge bead.

The present invention utilizes the circumstance that the difference between cans of different size (in terms of diameter) is greater than the thickness of the individual front edge web. It is therefore possible to arrange such front edge webs in radially spaced locations from one another, so that the thickness of the edge bead of the can extend into the space between the edge webs located at radially spaced locations relative to one another.

This offers the advantage that the individual can cap can be used for cans with different diameters without the edge bead of the individual can representing any hindrance.

Provisions are made within the framework of an advantageous embodiment of the present invention that two inner individual webs are arranged at spaced locations from one another along a circular path extending to the smaller lid edge bead. The space should be understood to be peripheral, i.e., along a circular path. This is to be understood as a spanning path for the cap according to the present invention in relation to a can with the smallest diameter.

If the same cap is to be used for a can of larger diameter, the outer, possibly curved individual web of the cap, which may also be subdivided into individual partial webs, will act. The outer individual web has, of course, a larger diameter than the inner individual webs. The outer individual web is preferably located radially behind the gap between the two inner individual webs.

The present invention does not exclude the arrangement of further individual webs spaced radially in relation to one another.

According to the invention, the cap body is formed of plastic and positionable over the lid. The cap body includes a sealing ring engageable with the lid wall part surrounding the opening. The sealing ring is held by a circular guide web 14, on the sealing ring's outer periphery, and the sealing ring has an inner periphery engaging a fitting plate. The fitting plate has an upper surface which is spaced from the upper surface of the cap body. This provides a guide for the sealing ring providing a proper mounting of the sealing ring.

According to the arrangement described above with the fitting plate and sealing ring, holes are provided in the fitting plate. According to a preferred form of the invention, the fitting plate is provided with two holes, the first of which is lined with a pouring attachment of the cap body (spaced from the pouring attachment) and the second opening is provided opening into a gap defined by the spacing between the cap body and the fitting plate.

In such a cap, it is ensured that both the sealing of said cap against the can, and a fluid-mechanically satisfactory outflow from the can is achieved. In prior-art can caps, e.g., those according to European Patent No. 0,045,439, a side canal, which is intended to ensure the supply of outside air into the inner space of the can during pouring in order to prevent a vacuum from forming within the can, is located in the immediate vicinity of the pouring opening. However, it was found in practice that pouring openings and ventilating openings located at such a closely spaced location to one another are simultaneously covered by the liquid level and therefore become ineffective. However, with the design according to the invention, there is a greater distance between the pouring opening and the opening acting as a ventilating opening, as a result of which the above-described disadvantage cannot occur.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
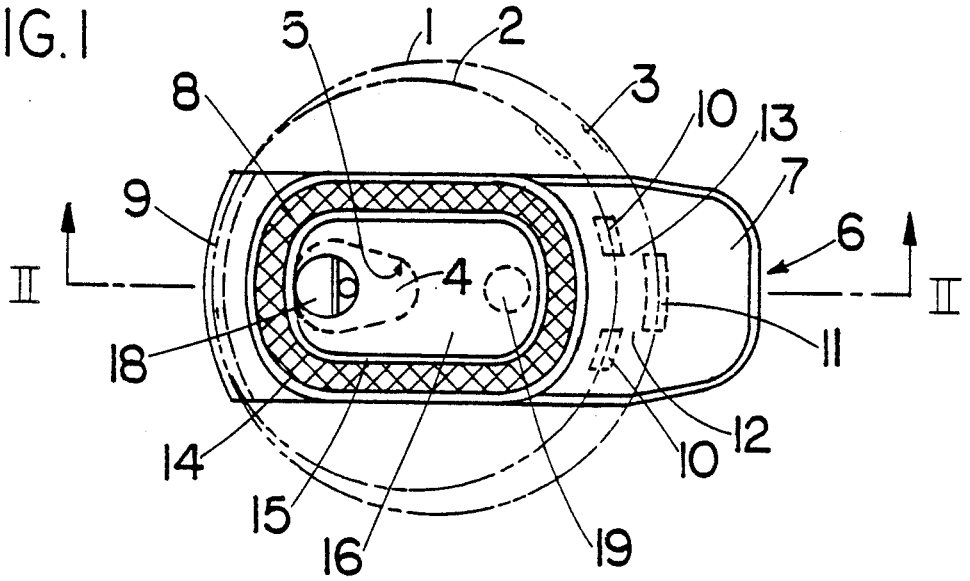
FIG. 1 is a top view of a cap for cans of various diameters.

Referring to the drawings, in particular, the invention embodied therein includes a cap arrangement for cans such as for one of cans 1 and 2, wherein the cans include a lid with a lid wall part 4 which may be torn away or pulled away to provide a lid pouring opening 5.

The example in FIG. 1 shows symbolically two cans 1 and 2 of different diameters. The can cap 6 according to the present invention has the task of sealing such cans 1, 2 of different diameters uniformly and tightly.

The lid of such cans 1, 2 contains, in general, lid wall parts 4 that can be torn off and form the pouring opening 5 after being torn off. Said pouring opening 5 is to be sealed with the can cap.

The can cap according to the present invention consists of a basic body 7 made of plastic, on whose side facing the can a sealing ring 8 is guided and fastened. The sealing ring 8 (see FIG. 2) encircles the pouring opening 5 of the can lid and must be pressed against the lid 4 in order to bring about sealing.

Figure 2:
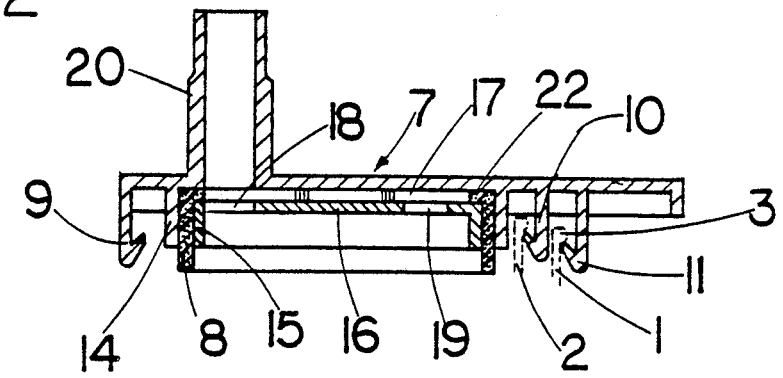
FIG. 2 is a cross sectional view taken through the can cap of FIG. 1 along line II—II; and, FIG. 3 is a cross sectional view similar to FIG. 2 showing an alternative embodiment of the invention.

According to FIG. 2, the sealing ring 8 is fixed on the basic body 7 by an outer guide web 14, which is arranged in a circular pattern. On the inside, the sealing ring 8 is fixed by an inner guide web 15, which is part of a plate 16 that can be connected to the basic body 7 via suitable centering and fixing means. The sealing ring 8, which is thus guided and held on both sides, must be pressed against the lid of the can 1, 2, regardless of the diameter of the can. To reach the pressing pressure, front edge webs 9, 10, 11 projecting in the direction of the can, which surround the edge bead 3 of the can, are provided on said basic body 7. The front edge web 9 has a greater length and is curved. Consequently, this front edge web 9 forms a centering means for attaching the can cap for cans of different size by the front edge web 9 reaching under the edge bead 3 of the individual can 1, 2.

On the opposite side of said can cap 6, there are provided individual webs 10, 11 of different diameters relative to the front edge web 9. The individual webs 10, 11 are at spaced locations 12 relative to one another in the radial direction, and this space, between the individual webs 10, corresponds approximately to the thickness of the individual edge bead 3 of the cans 1, 2. This makes it possible to place the same can cap 6 resiliently either on can 2 of smaller diameter or on can 1 of larger diameter or the like and to close these cans 1, 2, because if a can 1 of larger diameter is to be closed, this can must be able to extend with its edge bead 3 into the spacing 12 between the individual front edge webs 10, 11 without hindering closing.

According to FIG. 1, it is advisable to maintain the inner individual webs 10 at spaced locations from one another in the circumferential direction and to provide the outer individual web 11 behind the gap 13 between the inner individual webs 10 in the radial direction.

Figure 3:
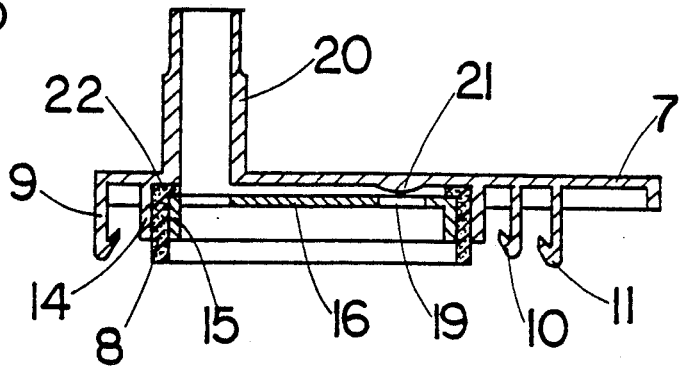

FIGS. 2 and 3 show measures by which the present invention can be used in the case of a can cap 6 which has a pouring opening provided with a pouring attachment 20. (The pouring attachment in turn is known from FIG. 3 of European Patent No. 0,045,439).

In can caps of this type, it is important to facilitate emptying of the can 1, 2 from a fluid mechanical viewpoint.

To achieve this, the plate 16 is at a spaced location from the basic body 7 of the can cap 6 in FIGS. 2 and 3 according to the present invention. This spacing is indicated by the gap 17. The plate 16 has two openings 18, 19, one of which, i.e. 18 is coaxial to the pouring attachment 20 of the can cap 6. The other opening 19 opens into the spacing 17 between said basic body 7 and said plate 16, and therefore it provides an opening located at a distance from the pouring attachment 20 to ventilate the interior space of the can 1, 2 during pouring.

FIG. 2 also shows that the outer front edge web 11 extends beyond the inner front edge web 10. This satisfies the condition that the inner front edge webs 10 must not exert a repelling effect when they grip behind larger cans.

FIG. 3 shows that the basic body 7 may have a convex attachment 21, which projects in the direction of the opening 19, and this narrows the discharge cross section of the discharge opening 19. Slower outflow from the pouring attachment 20 is thus achieved.

Finally, FIG. 2 shows that the sealing ring 8 has a strip-shaped web 22 extending in parallel to the basic body 7, which web 22 is inserted between said basic body 7 and said plate 16 in a sealing manner. The zone between said basic body 7, said plate 16, and said sealing ring 9 is thus completely sealed.

While specific embodiments of the invention have been shown and described in detail to illustrate the application of the principles of the invention, it will be understood that the invention may be embodied otherwise without departing from such principles.

What is claimed is:

1. A cap arrangement for cans having a lid edge bead and a lid with a lid wall part that may be opened to form a pouring opening, comprising: a cap body formed of plastic positionable over said lid, said cap body including a sealing ring engageable with the lid wall part surrounding the opening, said cap body including a single front edge web for gripping behind said lid edge bead, said front edge web having a curvature substantially corresponding to a curvature of the lid bead and plural individual webs spaced radially from said front edge web, said individual webs being positioned at radially spaced locations from one another corresponding to a thickness of the lid edge bead to provide an outer individual web and an inner individual web with respect to the can.

2. A cap according to claim 1, wherein the inner individual web includes first and second inner individual webs arranged at spaced locations from one another along a circular path.

3. A cap according to claim 2, wherein the first and second inner individual webs are spaced to form a gap therebetween, the outer individual web is positioned facing said gap.

4. A cap arrangement for cans having a lid edge bead and a lid with a lid wall part that may be opened to form a pouring opening, comprising: a cap body formed of plastic positionable over said lid, said cap body including a sealing ring engageable with the lid wall part surrounding the opening, said cap body including a curved front edge web for gripping behind the lid edge bead, the front edge web having a curvature substantially corresponding to a curvature of the lid edge bead, plural individual webs spaced radially from said front edge web, said sealing ring having an outer surface engaging a circular guide web and having an inner surface engaging a fitting plate, said fitting plate having an upper surface spaced from an interior surface of said cap body to define a gap, said fitting plate having first and second openings, said first opening being aligned with a pouring attachment of said cap body, spaced a distance from said pouring attachment, said second opening opening into said gap formed between said cap body and said fitting plate.

5. A cap arrangement according to claim 4, wherein said interior side of said cap includes a convex projection extending in the direction of said second opening.

6. A cap according to claim 4, wherein said fitting plate includes an edge with a circular counter web for engaging and supporting said interior side of said sealing ring.

7. A cap arrangement according to claim 4, wherein said sealing ring includes a circular, strip-shaped web extending parallel with the interior surface of said cap body, said strip-shaped web extending inwardly and mounted between said cap body and said fitting plate.

8. A cap arrangement according to claim 1, wherein said outer individual web extends beyond said inner individual web.

9. A cap closure for cans provided with a lid edge bead and a lid with a lid wall part that may be opened to form a pouring opening, comprising a closure body formed of plastic positionable over said lid, said closure body including a sealing ring, said sealing ring being engageable with said lid wall parts surrounding the opening upon pressing the closure body against the lid wall part surrounding the pouring opening, said closure body including a curve front edge web extending downwardly for engagement with the lid edge bead of the cap, said front edge web having a curvature substantially adapted to the diameter of the lid edge bead, and at least three single webs positioned on a side of said cap substantially opposite said curved front edge web, said at least three single webs including two inner single webs arranged at spaced locations from each other with respect to a circular shape of the lid edge bead of a smaller type can and a curved single web arranged between a gap between said two inner single webs at a radially spaced interval that corresponds to the thickness of the lid edge bead, corresponding to a larger diameter can.

* * * * *

UNITED STATES PATENT AND TRADEMARK OFFICE

CERTIFICATE OF CORRECTION

PATENT NO. : 5,062,552

DATED : November 5, 1991

INVENTOR(S) : Walter Heubl

It is certified that error appears in the above-identified patent and that said Letters Patent is hereby corrected as shown below:

Title Page:

[76] Inventor:

Please change the spelling of the inventor's name from "Walter Heubel" to --Walter Heubl--.

Signed and Sealed this

Fourth Day of May, 1993

Attest:

Michael K. Kirk

MICHAEL K. KIRK

Attesting Officer

Acting Commissioner of Patents and Trademarks